US006176070B1

(12) United States Patent
Grabher

(10) Patent No.: US 6,176,070 B1
(45) Date of Patent: Jan. 23, 2001

(54) PACKAGING APPARATUS FOR CLOSING A CAN WITH A CLOSURE MEMBER

(76) Inventor: Werner Grabher, Oberwingerstrasse 8, Ch-9436 Balgach (CH)

( * ) Notice: Under 35 U.S.C. 154(b), the term of this patent shall be extended for 0 days.

(21) Appl. No.: 09/239,946

(22) Filed: Jan. 29, 1999

Related U.S. Application Data

(63) Continuation-in-part of application No. 08/832,695, filed on Apr. 11, 1997.

(30) Foreign Application Priority Data

Jul. 21, 1996 (EP) ..... 96111740
Jan. 26, 1997 (EP) ..... 97101183

(51) Int. Cl.[7] ..... B65B 51/10

(52) U.S. Cl. ..... 53/478; 53/329.2; 156/69; 156/583.1

(58) Field of Search ..... 156/69, 499, 580, 156/583.1; 53/467, 471, 476, 477, 478, 329, 329.2, 329.3, 352

(56) References Cited

U.S. PATENT DOCUMENTS

| | | | |
|---|---|---|---|
| 1,086,007 | 2/1914 | Wollitzer . | |
| 1,750,204 | 3/1930 | Wichner . | |
| 1,790,068 | 1/1931 | Murphy . | |
| 1,808,975 | 6/1931 | Wright . | |
| 2,006,952 | 7/1935 | Klein . | |
| 2,033,888 | 3/1936 | Bombard . | |
| 2,037,675 | 4/1936 | Boothby et al. . | |
| 2,109,716 | 3/1938 | Annen . | |
| 2,226,178 | 12/1940 | Page . | |
| 2,244,940 | 6/1941 | Carruth . | |
| 2,336,852 | 12/1943 | Elmendorf . | |
| 2,551,090 | 5/1951 | Bergstein . | |
| 2,671,593 | 3/1954 | Page . | |
| 2,858,037 | 10/1958 | Rose . | |
| 3,157,336 | 11/1964 | Elam . | |
| 3,204,849 | 9/1965 | Vinney . | |
| 3,288,341 | 11/1966 | Krause . | |
| 3,299,845 * | 1/1967 | Geiger et al. | 413/26 |
| 3,498,521 | 3/1970 | Gill . | |
| 3,700,018 | 10/1972 | Goglio . | |
| 3,712,530 | 1/1973 | Croley . | |
| 3,912,154 | 10/1975 | Godar . | |
| 3,935,615 | 2/1976 | Wakeman . | |
| 3,937,392 | 2/1976 | Swisher . | |
| 4,042,164 | 8/1977 | Croley . | |
| 4,094,457 | 6/1978 | Spillson . | |
| 4,109,848 | 8/1978 | Kipp et al. . | |
| 4,153,196 | 5/1979 | Dutcher . | |
| 4,157,147 | 6/1979 | DeForest et al. . | |
| 4,289,265 | 9/1981 | Ellerbrock . | |
| 4,341,337 | 7/1982 | Beach, Jr. et al. . | |
| 4,495,209 | 1/1985 | Whiteside . | |

(List continued on next page.)

FOREIGN PATENT DOCUMENTS

| | | |
|---|---|---|
| 881899 | 7/1953 | (DE) . |
| 8108034 | 7/1984 | (DE) . |
| 4234857 | 4/1994 | (DE) . |
| 0007487 | 2/1980 | (EP) . |
| 0241026 | 10/1987 | (EP) . |
| 0611703 | 8/1994 | (EP) . |
| 9803278 | 1/1998 | (WO) . |

*Primary Examiner*—Michael W. Ball
*Assistant Examiner*—John T. Haran
(74) *Attorney, Agent, or Firm*—Rothwell, Figg, Ernst & Manbeck, p.c.

(57) ABSTRACT

A can is closed with a membrane by heat-sealing, using a packaging apparatus with an inner, heat-sealing die and an outer sealing ring displaceably located around the heat-sealing die, wherein an outer surface of the heat-sealing die and an inner surface of the sealing ring are beveled slightly, preferably by approximately two degrees, in mating fashion.

5 Claims, 2 Drawing Sheets

U.S. PATENT DOCUMENTS

| | | | |
|---|---|---|---|
| 4,527,699 | 7/1985 | Namba et al. . | |
| 4,564,139 | 1/1986 | Reil . | |
| 4,599,123 | 7/1986 | Christensson . | |
| 4,706,874 | 11/1987 | Reil . | |
| 4,736,885 | 4/1988 | Negus, Sr. . | |
| 4,799,590 | 1/1989 | Furman . | |
| 4,850,506 | 7/1989 | Heaps, Jr. et al. . | |
| 5,074,099 | 12/1991 | Andersson et al. . | |
| 5,913,798 * | 6/1999 | Grabher | 53/478 |

* cited by examiner

PACKAGING APPARATUS FOR CLOSING A CAN WITH A CLOSURE MEMBER

This application is a continuation-in-part of pending U.S. Ser. No. 08/832,695, filed Apr. 11, 1997.

BACKGROUND OF THE INVENTION

The invention relates to a packaging apparatus for closing a can with a closure member.

In general, cans as referred to herein differ from boxes or cartons in that cans are hermetically sealed, i.e., the contents are sealed in liquid-tight and preferably gas-tight fashion. Boxes or cartons, on the other hand, are typically closed simply by means of tabs or flaps or folded-in corner portions that do not provide for such tight, hermetic sealing.

A can is usually sealed with at least one closure member at a first end thereof. By connecting the can body to the closure member, the cylinder is given the desired shape cross-section, at least in the region of the closure element. After the can is filled, a further closure member may be sealed to the opposite end of the lateral surface or body member so that the can is completely sealed and the cylinder has a desired shape at the second end as well.

In case of a folded cylinder having at least two folding edges, the folding edges are formed (in particular bent and/or fluted) and circumferentially located in such a way that the lateral wall or body-forming portion of the can can be collapsed flat before insertion of a closure member. In the flat state, the volume of the cylindrical, body-forming member corresponds essentially to the material volume. In other words, essentially no empty volume is transported during transportation from the cylinder factory to the filling line. The foldable cylinder then is unfolded—preferably just before filling—and is sealed in the manner described above.

The closure members are initially completely separate from the lateral surface portion of the can body. They are, in general, formed as a single piece and comprise a closing surface, which is the same as the can cross-section, and an annular contact region by which they can be sealed tightly to the inside lateral can surface around the entire can circumference. (For purposes of the invention all continuous (i.e., unbroken), closed surfaces will be referred to as annular regardless of whether their contour is circular, oval, or polygonal and regardless of whether they are formed with straight or curved lines.)

Cans having a cardboard lateral surface are frequently cylindrical with the lateral surface being formed as a wound cardboard tube. In the case of a foldable cylinder having just two folding edges, the cross-section can become increasingly flat with increasing distance from a closure member, depending on the method of unfolding. Therefore, in order to achieve a better approximation to the desired circular cross-section along the length of the can, more folding edges can be provided, and a circular closure member be applied. In addition, the cylinder can be spread apart by a shaping means during unfolding, and/or the folding edges can be flattened out.

The final shape of the can also depends on the filling and on the second closure member. High resistance to deformation or crushing of the middle region of the can is achieved if the can cross-section is as circular as possible. However, elliptical closure members, those which comprise circular segments or parts of ellipses, or polygonal closure members (particularly having an even number of sides that are of the same length, and preferably having rounded corners) may also be provided instead of circular closure members.

With said can, it is also possible to provide unusual shapes in a simple manner. Specifically, the folding lines need not be flattened out, but can be used as the edges of a polygonal can cylinder. Accordingly, the closure members or the bottom and the lid would also be polygonal, i.e., the number of folding edges and the number of corners of the closure members would correspond. In particular, tetragonal, preferably hexagonal or even octagonal to dodecagonal cans can be provided with closure members according to the invention.

Since the "closed" (i.e., continuous) or annular contact surface of each of the closure members presses tightly against the inside of the lateral surface, the can or the foldable cylinder has excellent stability and seal tightness. Closure members having high tensile strength—e.g., closure membranes which are firmly connected to the inside of the lateral surface or body member in a tensioned state—may be used. The membrane comprises a plastic film or paper sheet, but preferably an aluminum foil, and is hermetically sealed to the internal lateral can surface.

If the closure member is firmly connected to a free cylinder edge along the edge, the cylinder is given the desired shape or cross-section at least in the region of the closure member. After filling, another closure member is mounted at a second, opposite region of the cylinder so that the can is closed and the cylinder is given the desired shape in the second end region as well.

For the insertion and sealing of closure members, preferably by means of a hot-melt adhesive, it is possible to use press apparatuses which press against the annular contact surfaces of the closure member and the cylinder from within and without (optionally from only one side) and supply heat to the contact surfaces during heat-sealing. Depending on the particular arrangement of the contact surfaces, the sealing surfaces lie either in the interior of the cylinder or along a separate sealing surface of the foldable cylinder.

A can closing press apparatus having at least one radially adjustable press surface is described in WO98/03278, for insertion of the closure member into a can. With such an apparatus, the press surface can be pressed against the contact surfaces after introduction of the apparatus. In the case of pressing from the inside of the cylinder, at least one press part (but preferably a plurality of press parts) having a convex press surface must be capable of being moved from a feed position in which it has a smaller press surface circumference to a pressing position in which it has a larger circumference. In the case of pressing from the outside of the cylinder, at least one press part (but preferably a plurality of press parts) having a concave press surface must be capable of being moved from a feed position in which it has a larger press surface circumference to a pressing position in which it has a smaller circumference. The parts which can be moved from the outside of the cylinder into their pressing positions may be dimensioned so that they form a step-free, closed (i.e., non-broken) circumferential line when they rest against one another.

However, such press apparatuses are mainly useful for cylindrically shaped can bodies having a circular cross-section. For non-circular shapes, such press appartuses become rather complicated, and if the cross-section becomes polygonal, a tight sealing in the corner edges is difficult to achieve.

U.S. Pat. No. 4,599,123 discloses a method for interconnecting a closure member with an annular contact region of the lateral can surface respectively jacket. The jacket is inserted in a weld ring with an entering cone edge. A press piston with a cone surface corresponding to the cone edge of the weld ring has to move down from a position distinctly above the weld ring. The press piston pushes the closure member into engagement with the jacket at the cone edge of the weld ring. The two cooperating press surfaces have conical sections in planes through the jacket axis, wherein the distance to the axis decreases towards the free end of the press piston. The weld ring supplies heat for welding the closure member to the jacket. After the welding the press piston has to move up and the jacket with the closure member can be pulled or pushed out of the weld ring. This solution has several disadvantages. The method is time consuming due to the movements of the press piston and the jacket. The press piston has to move quit a distance down and up. The jacket has to be inserted into and pulled out of the weld ring with the heat source. The welding is slow because only one press surface is at a high temperature. The cross section of the jacket is slightly increased at the free end of the jacket, due to the beveled press surfaces. This slightly outstanding jacket end is exposed to increased mechanical handling strain and causes problems with hooded lids.

SUMMARY OF THE INVENTION

The invention provides a packaging apparatus for closing a can with a closure member, especially (but not only) for a can which can be transported and stored in a compact folded manner and which can be provided as an unfolded fillable can that is hermetically sealed at the filling site at low cost.

The invention further provides a more universally applicable apparatus for closing a can with a membrane, which apparatus can be applied to can bodies having a circular cross-section but is especially advantageous to apply to non-circular cross-sections, especially to polygonal ones.

This is achieved by expediently sealing the closure membrane to the cylinder by means of a double cone sealing apparatus with a sealing ring displaceably located around a sealing die as described below.

BRIEF DESCRIPTION OF THE DRAWINGS

The invention will be described in detail with reference to the following drawings in which.

DETAILED DESCRIPTION OF PREFERRED EMBODIMENTS

Figure 1A:
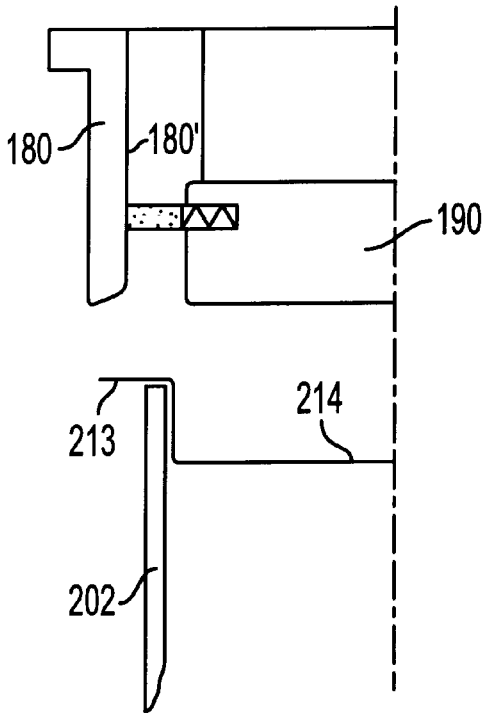
FIGS. 1A and 1B are schematic views demonstrating the sealing one opening of a can according to the invention by sealing-in a closure membrane 214.
Figure 1B:
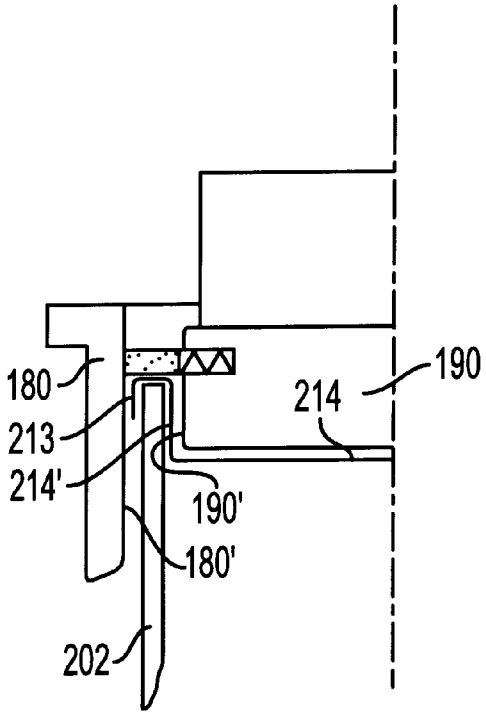

According to FIGS. 1A and 1B, a thermoformed membrane film 214 which has a collar 213 that projects over the upper edge of the can cylinder 202, rests with the collar on the edge of the cylinder. An outer sealing ring 180 having a slightly (e.g. by 2°) beveled inner surface 180' moves from an upper, waiting position (FIG. 1A) to a lower, sealing position (FIG. 1B) in which it seals the membrane collar 213 onto the outside of the cylinder and/or the axial part 214' of the membrane film 214 onto the inside surface of the cylinder. The inner heat-sealing die 190 has a complementarily slightly (e.g. by 2°) beveled outer surface 190' against which the sealing ring 180 presses when in the sealing position.

Figure 2B:
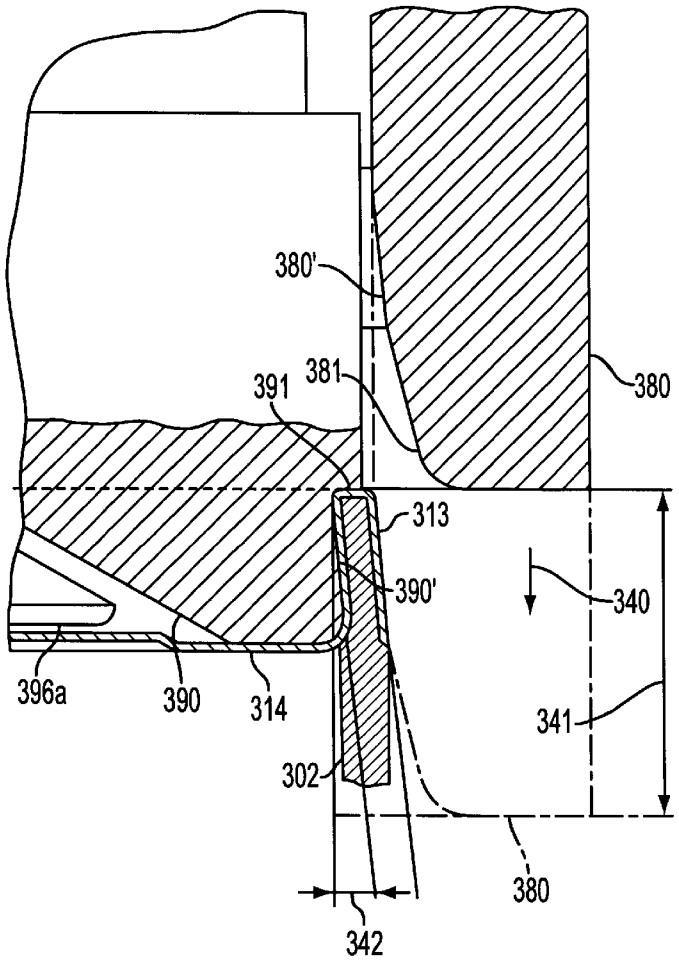
FIG. 2B is an enlarged part of a vertical cross section of a closing apparatus for a can, wherein the sealing ring is shown before (solid lines) and during (dotted lines) pressing.
Figure 2A:
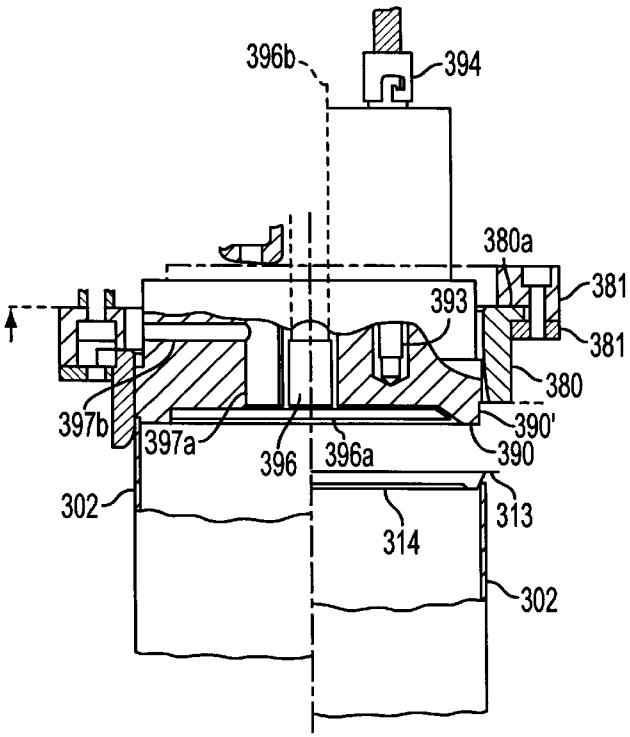
FIG. 2A is a vertical cross section of a closing apparatus for a can, wherein on the right side there is a situation before heat-sealing and on the left side there is a situation during heat-sealing.

According to the right side of FIG. 2A, a closure member 314 which has a collar 313 that projects over the upper edge of the can cylinder 302, rests at the beginning of a closing process with the collar 313 on the free end of the cylinder 302. The cylinder 302 with the closure member 314 is moved upwards towards a heated sealing die 390 having a slightly (e.g. by 2°) beveled outer surface 390'. Instead of moving the cylinder 302 upwards, the sealing die 390 could be moved downwards. The situation at the end of this movement can be understood from FIG. 2B. A shoulder 391 of the sealing die 390 stops the upward movement when the collar 313 at the free end of the cylinder 302 is in contact with it. At this moment the collar 313 is not yet in full contact with the beveled outer surface 390'. An arrow 340 indicates a downward movement of the sealing ring 380. A flared entering section 381 of the sealing ring pushes the radial outer edge of the collar 313 down and starts a radially inward bending of the free end of the cylinder 302. The pressing starts as soon as a beveled inner surface 380' gets in contact with the outer side of the cylinder 302. The pressing ends when the sealing ring 380 is at its lowermost position indicated by a dotted line. The distance between the lowermost and the uppermost position of the sealing ring 380 is indicated by the arrow 341.

In the lowermost position of the sealing ring 380 the inner and outer surfaces 380', 390' are at constant distance to each other. This distance corresponds to the final thickness of the compressed cylinder 302 and the two layers of the collar 313. The two cooperating press surfaces have conical sections which are tilted to the axis of the cylinder 302 by an angle 342 of about 2°, wherein the distance from the surfaces to the cylinder axis increases towards the free end of the press piston. Correspondingly at the end of the pressing the distance of the cylinder 302 to its axis decreases towards the free end of the cylinder 302. Since the angle 342 is rather small, the cylinder 302 with the closure member 314 can be pushed or pulled of the sealing die 390. The sealing area at the free end of the cylinder 302 has to be enlarged slightly. This enlargement is slightly elastic or at least partly inelastic. Therefore the pushed off cylinder 302 has at its free end again a constant or a slightly decreased cross section. Increased mechanical handling strain and problems with hooded lids are avoided.

According to FIG. 2A, the sealing die 390 includes at least one heating element (not shown) with a supply line (not shown) and a temperature sensor 393 with a connection line 394. A temperature control unit (not shown) controls the power supply of the heating element according to the actual temperature and at least one preset temperature value. The heated sealing die 390 has to supply the heat needed for the heat-sealing. A mechanical connecting means (not shown) interconnects the sealing die 390 with an upper part (not shown) of the closing apparatus. This upper part can be an upper stand at a height which is adjustable to the actual cylinder height. If the sealing die has to be moved down and up during the closing process then a moving unit is located in between the upper stand and the connecting means.

An ejector die 396 has an ejector surface 396*a* which is adjacent to the sealed-in closure member 314. An actuator means (not shown) is used for pushing the closed can of the sealing die 390 by moving a ejector rod 396*b* of the ejector die 396 relative to the sealing die 390. The rod 396*b* is located in a central bore through the sealing die 390. Venting bores 397*a* and 397*b* avoid a vacuum in between the closure member 314 and the sealing die 390.

The sealing ring 380 is displaceably located around the sealing die 390. Two interconnecting rings 381 are clamped to a radially projecting rim 380*a* of the sealing ring 380. At least one but preferably three pressing rods 382 are connected to the interconnecting rings 381. The pressing rods 382 are also connected to pressing means (not shown) which enable a movement up and down relative to the sealing die 390 over a height which is indicated by the arrow 341. The sealing die 390 and the sealing ring 380 have in all possible relative positions an overlapping height range and the needed press-movement of the sealing ring 380 is minimal compared to the movements of the solutions according to the state of the art. Another advantage of this solution is the fact, that there is no need for the cylinder to be inserted into and pulled out of a weld ring. All the parts of the closing apparatus are located above a cylinder 302 to be sealed. The cylinder can be positioned by any kind of known positioning means or even by hand.

Due to the overlapping height range, the sealing ring 380 is continuously heated by heat radiation of the sealing die 390. Therefor both pressing surfaces are more or less at the needed sealing temperature. This enables a faster sealing step without additional heating elements in the sealing ring 380.

It will be apparent that the invention is not restricted to the embodiments shown. Any desired closure member with any desired connection to the can cylinder can be used. Moreover, by using suitable hot-melt adhesives, it is possible, in certain circumstances, to connect together the abutting cylinder web edges without using connecting strips. Other embodiments are deemed to be within the scope of the following claims.

What is claimed is:

1. A packaging apparatus for closing a can with a closure member by heat-sealing, said packaging apparatus comprising a heat-sealing die with an outer surface and a sealing ring with an inner surface for contacting and heat-sealing a closure member to a can end opening so as to close the can end opening, wherein said inner and outer surfaces are extending annularly around a central axis, said sealing ring being located around said sealing die and displaceable relative to said sealing die in a direction of said central axis thereby enabling an adjacent positioning of said inner surface to said outer surface, and said inner surface being beveled toward the can opening, and said outer surface being correspondingly beveled in mating fashion with said inner surface.

2. Apparatus according to claim 1, wherein said inner and outer surfaces are each beveled by approximately two degrees.

3. Apparatus according to claim 1, wherein said inner and outer surfaces have distances to a central axes increasing toward a free end of said sealing die.

4. Apparatus according to claim 1, further including an ejector die for pushing a closed can out of the sealing die.

5. Apparatus according to claim 1, wherein said sealing die further includes at least one venting bore for preventing formation of a vacuum between said closure member and said sealing die.

* * * * *